US008628165B2

(12) United States Patent
Ito

(10) Patent No.: US 8,628,165 B2
(45) Date of Patent: Jan. 14, 2014

(54) IMAGE FORMING APPARATUS, IMAGE FORMING METHOD, PATTERN FORMING METHOD AND RECORDING MEDIUM

(75) Inventor: Takayuki Ito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 299 days.

(21) Appl. No.: 13/137,742

(22) Filed: Sep. 9, 2011

(65) Prior Publication Data

US 2012/0062643 A1 Mar. 15, 2012

(30) Foreign Application Priority Data

Sep. 15, 2010 (JP) ..... 2010-206606

(51) Int. Cl.
*B41J 29/393* (2006.01)

(52) U.S. Cl.
USPC ..... 347/19

(58) Field of Classification Search
None
See application file for complete search history.

(56) References Cited

FOREIGN PATENT DOCUMENTS

| | | | |
|---|---|---|---|
| JP | 2002086767 | A | 3/2002 |
| JP | 2006-173929 | A | 6/2006 |
| JP | 4385626 | B | 10/2009 |

*Primary Examiner* — Stephen Meier
*Assistant Examiner* — Tracey McMillion
(74) *Attorney, Agent, or Firm* — Harness, Dickey & Pierce, P.L.C.

(57) ABSTRACT

A disclosed image forming apparatus includes a recording head having nozzles discharging ink droplets to form dots on a recording medium based on image data supplied thereto. The image forming apparatus includes a detector configured to detect a defective nozzle that discharges a defective ink droplet forming an expected defective dot, a focus region setting unit configured to set a focus region including a position of the expected defective dot to be formed of the defective ink droplet discharged by the detective nozzle, and a rearranging unit configured to rearrange, when the defective nozzle is detected by the detector, the dots in the focus region based on a slope of a line image expressed by the supplied image data in the focus region and values indicating respective sizes of the dots in the focus region.

9 Claims, 17 Drawing Sheets

IMAGE FORMING APPARATUS, IMAGE FORMING METHOD, PATTERN FORMING METHOD AND RECORDING MEDIUM

BACKGROUND OF THE INVENTION

1. Field of the Invention

The disclosures herein relate to an image forming apparatus, an image forming method, a pattern forming method and a computer-readable recording medium storing an image forming program. More specifically, the disclosures herein relate to an image forming apparatus having a recording head, an image forming method, a pattern forming method and a computer-readable recording medium storing an image forming program capable of causing nozzles to discharge ink droplets to form dots on the recording medium based on input image data.

2. Description of the Related Art

Personal computers (PCs) and workstation workstations are examples of image processing apparatuses configured to process image data. Such an image processing apparatus generally includes application software operating on its own apparatus to generate image data formed of various objects (e.g., characters, solid shades, lines or photographs).

Examples of an image forming apparatus capable of forming the various images based on the image data include printers, facsimile machines, copiers, or multiple functional processing machines having combines functions of these. Examples of such an image forming method include an inkjet recording system and an electrophotographic printing system in which images are formed with an image forming material such as a recording liquid (ink) or toner.

An inkjet recording apparatus utilizing such an inkjet recording system for recording digital images is widely used as one of the image forming apparatuses. In general, the inkjet recording apparatus includes a print head as a recording unit, a carriage having an ink tank, a transferring unit for transferring recording sheets, and a control unit for controlling these components. At present, examples of the inkjet recording system include a serial head system and a line head system.

In the serial head system, a print head that discharges ink droplets from a number of discharge ports serially scans in a direction (main-scanning direction) perpendicular to a transferring direction of the recording sheet (sub-scanning direction) while intermittently moving by predetermined amounts during a non-printing operation. In the line head system, a print head having a printing width or plural print head arrayed in the printing width scans a recording sheet in one direction to form images. Further, in a color supporting inkjet recording apparatus, plural print heads corresponding to different colors discharge ink droplets of different colors such that the discharged ink droplets of different colors are superimposed to form a color image.

With the line head system, image formation is completed by a single scanning operation. With the serial head system, image formation may also be completed by selecting a single scanning operation.

The single scanning operation has an advantage of forming an image in a short time. Meanwhile, if the nozzles of the print head have some damage, dots may be formed in misaligned positions, or erroneous streaks may be formed instead of correct form of dots.

Japanese Patent Application Publication No. 2002-086767 (hereinafter referred to as "Patent Document 1") discloses a technology for preventing formation of such streaks formation. In this technology disclosed in Patent Document 1, a nozzle adjacent to a defective nozzle is configured to form a dot having a larger diameter by switching the drive of the nozzles in order to reduce the number of erroneous streaks formed by the defective nozzle. Further, Japanese Patent Application Publication No. 2006-173929 (hereinafter referred to as "Patent Document 2") discloses a technology for preventing inconsistent color intensity formation such as white streaks in the printed image due to discharging failure of ink.

FIG. 1 illustrates an example of image correction carried out by the technology disclosed in Patent Document 1. FIG. 1 is a diagram illustrating the example in which images are corrected by controlling intact nozzles adjacent to a defective nozzle exhibiting malfunctioning discharge (hereinafter simply called a non-discharging nozzle).

In this example of FIG. 1, the eight-dot printer head 10 includes a non-discharging nozzle 11 (i.e., defective nozzle). In FIG. 1, images 12, 13 and 14 are those to be formed by dots discharged from the nozzle 11. In FIG. 1, since the nozzle 11 is a damaged non-discharging nozzle, the images 12, 13, and 14 result in defective images (streaks). Further, in FIG. 1, images 12A, 13A, and 14A are corrected images formed with dots discharged from nozzles 11A and 11B adjacent to the non-discharging nozzle 11.

In the above related art technologies, the nozzles adjacent to the defective nozzle may correct defect of the image due to the dot discharged from the damaged non-discharging nozzle based on the discharged dot. Thus, if the image formed by the damaged non-discharge nozzle is a thin line, the thickness of the line of the corrected image may be changed or deformed as illustrated in FIG. 1.

For example, the image 12 (on the left hand side) is corrected by increasing the sizes of dots discharged from the nozzles 11A and 11B adjacent to the nozzle 11; however, the line of the corrected image 12A has been changed from that of the image 12 before correction as illustrated in FIG. 1. The line of an image 13 formed of dots discharged by the nozzle 11 is corrected by dots discharged by the nozzles 11A and 11B adjacent to the nozzle 11, thereby obtaining the corrected image 13A. Accordingly, the thickness of the line of the image 13A is partially changed, which results in the partially deformed line of the corrected image 13A. Similarly, a corrected image 14A includes a partially changed thickness of a line or a deformed line as a result of correcting the line of the image 14.

SUMMARY OF THE INVENTION

Accordingly, it is a general object of at least one embodiment of the present invention to provide an image forming apparatus, an image forming method, a pattern forming method, and a recording medium storing a program for executing the image forming method or the pattern forming method capable of forming a line image by reducing erroneous streaks due to defective ink discharge from the defective nozzle without deforming a shape of the line image, which substantially eliminate one or more problems caused by the limitations and disadvantages of the related art.

In one embodiment, there is provided an image forming apparatus including a recording head having nozzles discharging ink droplets to form dots on a recording medium based on image data supplied thereto. The image forming apparatus includes a detector configured to detect a defective one of the nozzles, the defective nozzle discharging a defective ink droplet forming an expected defective dot; a focus region setting unit configured to set a focus region including a position of the expected defective dot to be formed of the defective ink droplet discharged by the detective nozzle; and a rearranging unit configured to rearrange, when the defective nozzle is detected by the detector, the dots in the focus region based on a slope of a line image expressed by the supplied image data in the focus region and values indicating respective sizes of the dots in the focus region.

In another embodiment, there is provided a method for forming an image implemented by an image forming apparatus including a recording head having nozzles discharging ink droplets to form dots on a recording medium based on image data supplied thereto. The method includes detecting a defective one of the nozzles, the defective nozzle discharging a defective ink droplet forming an expected defective dot; setting a focus region including a position of the expected defective dot to be formed of the defective ink droplet discharged by the detective nozzle; and rearranging, when the defective nozzle is detected, the dots in the focus region based on a slope of a line image expressed by the supplied image data in the focus region and values indicating respective sizes of the dots in the focus region.

In another embodiment, there is provided a non-transitory computer-readable medium storing an image forming program for forming an image implemented by an image forming apparatus including a recording head having nozzles discharging ink droplets to form dots on a recording medium based on image data supplied thereto. The image forming program causes, when processed by a processor, the image forming apparatus to execute a process including detecting a defective one of the nozzles, the defective nozzle discharging a defective ink droplet forming an expected defective dot; setting a focus region including a position of the expected defective dot to be formed of the defective ink droplet discharged by the detective nozzle; and rearranging, when the defective nozzle is detected, the dots in the focus region based on a slope of a line image expressed by the supplied image data in the focus region and values indicating respective sizes of the dots in the focus region.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, preferred embodiments will be described with reference to the accompanying drawings.

A focus region is initially set based on a location of a defective nozzle, and dots in the focus region are rearranged such that an angle (slope) of a line formed by connecting gravity centers of the dots in the focus region and values indicating ink droplets levels (i.e., sizes) in the focus region have the same angle and the same values as those of dots in the focus region before correction.

First Embodiment

In the following embodiments, an inkjet recording apparatus is utilized as an image forming apparatus.

Figure 1:
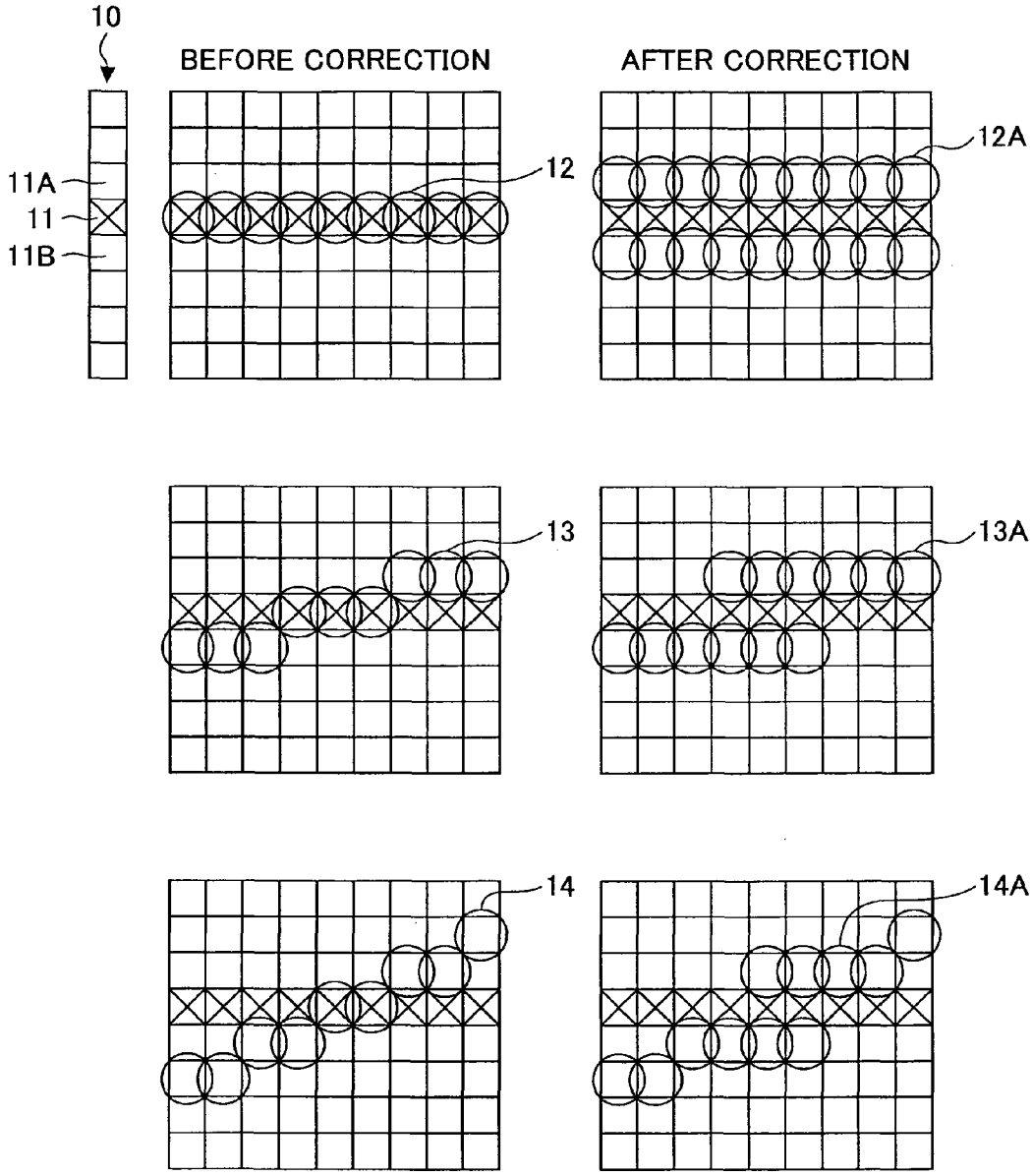
FIG. 1 is a diagram illustrating examples of images corrected by controlling intact nozzles adjacent to the defective nozzle (exhibiting malfunctioning discharge)
Figure 2:
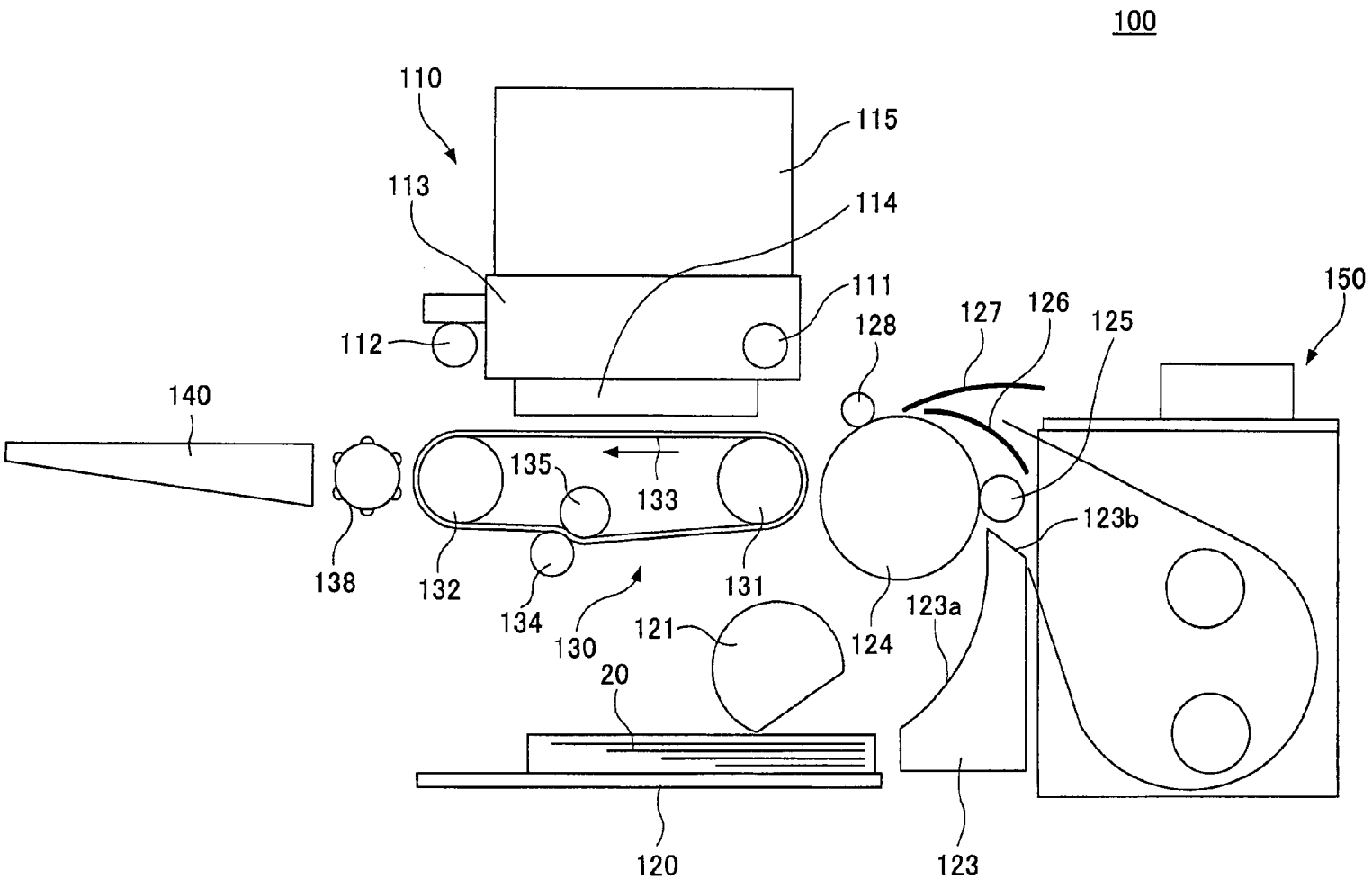
FIG. 2 is a diagram illustrating an image forming apparatus according to a first embodiment.

FIG. 2 is a diagram illustrating an image forming apparatus 100 according to a first embodiment.

The image forming apparatus 100 includes an image forming unit 110, a feeder tray 110, a transfer mechanism 130 and an output tray 140. The image forming unit 110 is provided inside a main body of the image forming apparatus 100, and the feeder tray 120 is arranged at a lower part of the main body of the image forming apparatus 100 such that numerous recording media are allowed to be stacked on the feeder tray 120. The output tray 140 is attached to a side of the main body of the image forming apparatus.

In the image forming apparatus 100, the image forming unit 100 records a desired image on a sheet 20 fed from the feeder tray 120 while being transferred by the transfer mechanism 130 and outputs, when finishing recording, the sheet 20 to the output tray 140.

The image forming apparatus 100 further includes a double-side unit 150 detachably provided in the main body of the image forming apparatus 100. In the first embodiment, when conducting double side printing, after an image is printed on a first surface (front-surface) of the sheet 20, the double-side unit 150 catches the sheet 20 while the sheet 20 is transferred by the transfer mechanism 130 in a reverse direction the sheet 20. The double-side unit 150 turns the sheet 20 in an opposite direction such that a second surface (a rear surface) of the sheet 20 is printable, and transfers the sheet 20 to the transfer mechanism 130 again. The image is then printed on the second surface of the sheet 20 and the printed sheet 20 is discharged on the output tray 140.

The image forming unit 110 includes a carriage 113 slidably supported by guide shafts 111 and 112 such that a main scanning motor (not illustrated) causes the carriage 113 to travel in a (main-scanning) direction perpendicular to a transferring direction of the sheet 20. The carriage 113 includes a recording head 114 having arrays of nozzle ports 114*n* (see FIG. 4) as discharging ports configured to discharge liquid droplets, and also includes a removable ink cartridge 115 configured to supply liquid into the recording head 114. Note that the carriage 113 may be configured to include a sub-tank instead of the ink cartridges, such that ink is supplied to the sub-tank from a main-tank.

Figure 3A:
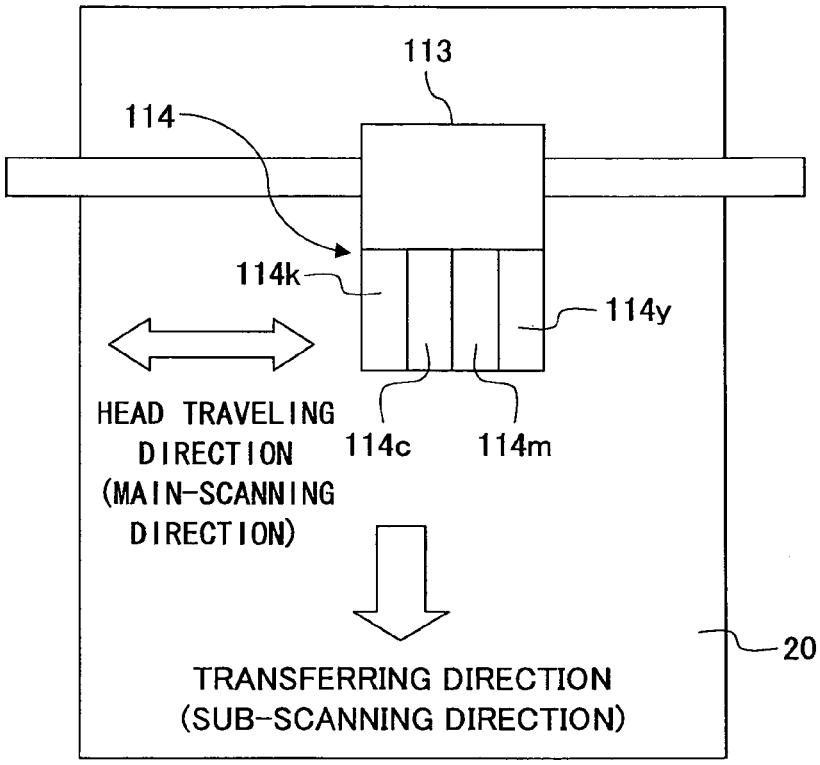
FIGS. 3A and 3B are first diagrams illustrating examples of a recording head.
Figure 3B:
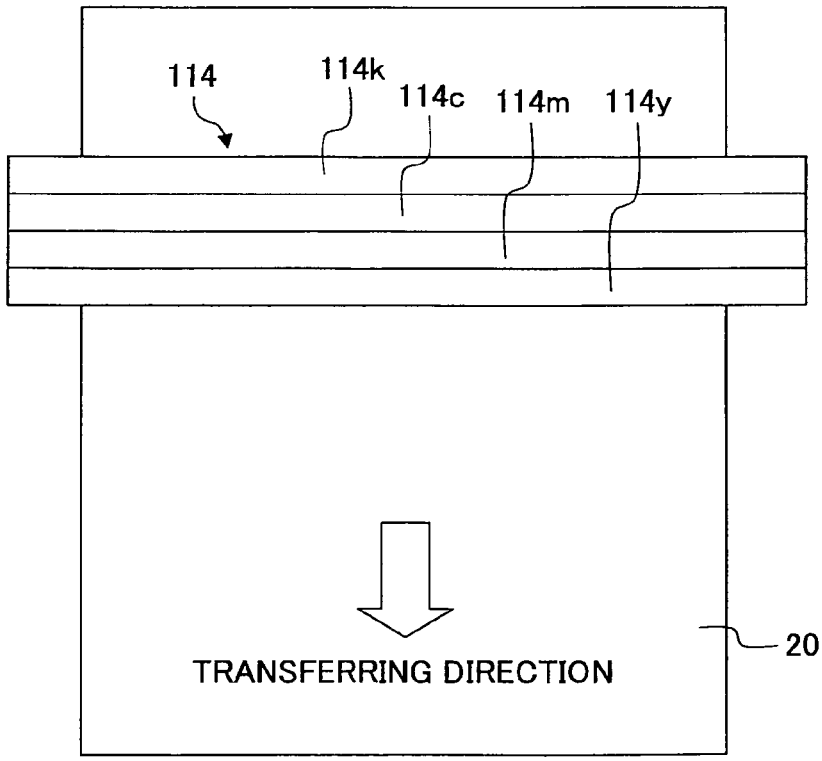
Figure 4:
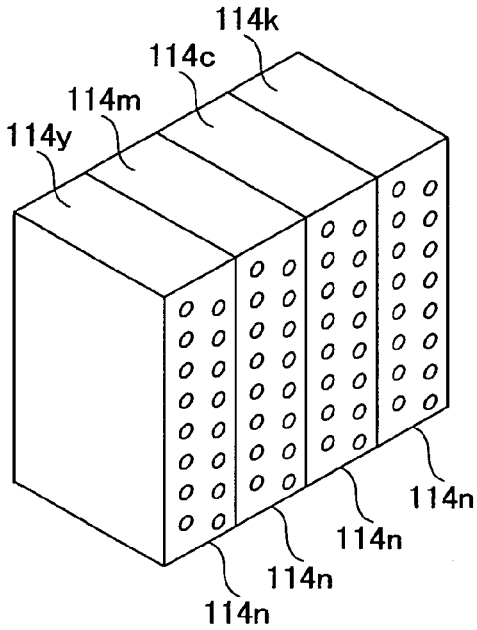
FIG. 4 is a second diagram illustrating an example of the recording head.

Next, the recording head 114 utilized in the image forming apparatus 100 according to the first embodiment is described with reference to FIGS. 3A and 3B. FIGS. 3A and 3B are diagrams illustrating examples of the recording head. FIG. 3A illustrated a recording head with a serial head system and FIG. 3B is a recording head with a line head system. FIG. 4 is another diagram illustrating an example of the recording head.

The recording head 114 utilized in the image forming apparatus 100 according to the first embodiment may be formed of separate four inkjet heads 114*y*, 114*m*, 114*c* and 114*k* configured to individually discharge ink droplets of four colors, that is, yellow (Y), magenta (M), cyan (C) and black (Bk). Alternatively, the recording head 114 may be formed of one or more inkjet heads having plural nozzles 114*n* configured to discharge ink droplets of the respective colors. Note that the number of colors or the order of nozzle arrays may not be limited to the above construction.

Preferable examples of the four inkjet heads forming the recording head 114 include an energy generator configured to discharge ink, such as a piezoelectric actuator such as a piezoelectric element, a thermal actuator utilizing a phase change caused by liquid film boiling by an electrothermal element such as a heat element, a shape memory alloy actuator utilizing a metallic phase variation due to temperature variation, and a static actuator.

A preferable example of the electrothermal element may include a non-linear property. The electrothermal element having the non-linear property may exhibit little change in its resistance value when a low voltage is applied to the electrothermal element but may exhibit a significant change in its resistance value when a voltage higher than a predetermined voltage is applied to the electrothermal element. When plural heater units formed of the electrothermal elements having the non-linear property are selectively driven, a noise voltage is applied to unselected heater units, which may result in energy waste or may affect the driving voltage to change the discharged amount of ink, thereby affecting the recorded image.

In the inkjet recording head, a voltage is applied to vertical wires and horizontal wires to selectively drive the heater units arranged in a matrix of nodes at intersections of vertical and horizontal wires. However, with this configuration, a voltage lower than the driving voltage may be applied to unselected heater units in a driving process. Moreover, if the voltage lower than the driving voltage is the voltage in a forward direction, the unselected heater units may generate unnecessary heat. In addition, if the unnecessarily generated heat is accumulated in the inkjet recording head, the heater units, upon being heated to allow the inkjet recording head to discharge ink, may generate heat in excess of a predetermined amount. As a result, the inkjet recording head may discharge an excessive amount of ink. In this condition, amounts of ink discharged from the different nozzles may vary.

However, if the heater units are formed of the electrothermal elements having the non-linear property, the heater units, to which the voltage lower than the driving voltage such as a noise voltage is applied, may avoid generating unnecessary heat. As a result, the variability in the amounts of ink discharged from the nozzles may be controlled, and the printed product may exhibit reasonable graininess or gradation. Further, since the heater units are prevented from generating unnecessary heat, energy may also be prevented from being wasted.

Further, the resistance values of the electrothermal elements of the recording head 114 may be measured and the driving voltages applied to the electrothermal elements may be adjusted based on the measured resistance values. Specifically, if the recording head 114 has a longer configuration, the resistance values of the electrothermal elements are varied between the nozzles. As a result, the amounts of ink discharged from the different nozzles are also be varied. However, if the voltages applied to the electrothermal elements are adjusted based on the feedback of the resistance values, ink droplets having a desirable droplet size may be discharged from the respective nozzles.

Moreover, if a thermal recording head 114 is utilized in the image forming apparatus 100, the electrothermal elements (discharging energy generators) may be provided with protective layers. If the electrothermal elements are provided with the protective layers, kogation (charring of ink components) or cavitations (destruction due to air bubble compression impact) may not directly affect the electrothermal elements. Thus, the electrothermal elements may be only minimally damaged and have longer life.

Referring back to FIG. 2, the sheets 20 in the feeder tray 120 is are separated one by one by a feeder roller (semicircular roller) 121 and a separating pad (not illustrated) and the sheet 20 separated from the rest is fed inside the image forming apparatus 100 and is then transferred to the transfer mechanism 130.

The transfer mechanism 130 includes a transfer guide unit 123, a transfer roller 124, a pressurizing roller 125, guide members 126 and 127, and a thrust roller 128. The transfer guide unit 123 is configured to guide the sheet 20 fed from the feeder tray 120 along a guide surface 123*a* of the guide unit 123, and also guide the sheet 20 fed from the double-side unit 150 along a guide surface 123*b* of the guide unit 123. The transfer roller 124 is configured to transfer the sheet 20. The pressure roller 125 is configured to pressurize the sheet 20 against the transfer roller 124.

The guide member 126 is configured to guide the sheet 20 along the transfer roller 124 side and the guide member 127 is configured to guide the sheet 20 the double side unit 150. The thrust roller 128 is configured to thrust the sheet 20 to be transferred from the transfer roller 124.

The transfer mechanism 130 includes a transfer belt 133, a charger roller 134 and a guide roller 135 for transferring the sheet 20 while maintaining a flat configuration along the recording head 114. The transfer belt 133 is looped over a driving roller 131 and a driven roller 132. The charger roller 134 is configured to charge the transfer belt 133. The guide roller 135 is placed at a position facing the charger roller 134.

Although not illustrated in the figures, the transfer mechanism 130 further includes guide members (platen plates) configured to guide the transfer belt 133 in a region facing the image forming unit 110, and a cleaning roller formed of a porous body for removing a recording liquid (ink) attached to the transfer belt 133.

The transfer belt 133 is an endless belt that is looped over the driving roller 131 and the driven roller 132 so as to circumferentially travel in a direction indicated by an arrow in FIG. 2 (i.e., a sheet transferring direction).

Figure 5:
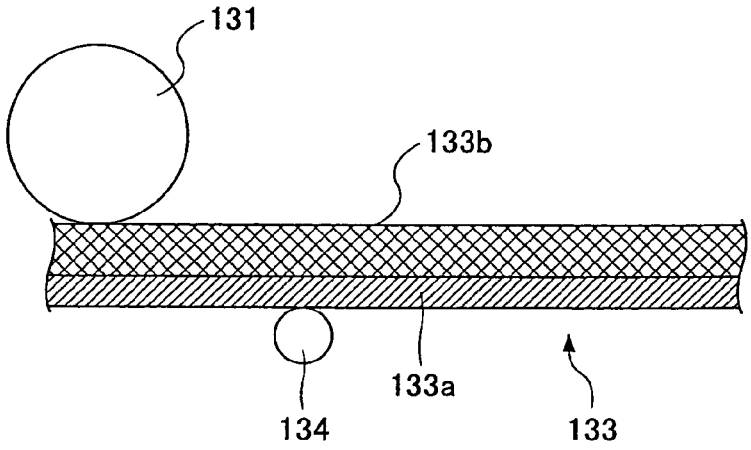
FIG. 5 is a diagram illustrating a transfer belt.

The transfer belt 133 may be a single-layer configuration, a two-layer configuration having a first layer (i.e., an outermost surface layer) 133*a* and a second layer (i.e., a rear surface layer) 133*b* as illustrated in FIG. 5, or a multiple-layer configuration having three or more layers. FIG. 5 is a diagram illustrating the transfer belt 133. The transfer belt 133 may include the first layer (outermost surface layer) 133*a* serving as a sheet adsorbing surface formed of a resin material (ETFE pure material) having a pure thickness of 40 μm without resistance control treatment and the second layer (rear surface layer 133*b*, middle resistance layer or earth layer) formed of the same material as the first layer and having resistance control treatment with carbon.

The charger roller 134 is configured to be brought into contact with the surface layer of the transfer belt 133 and is arranged such that the charger roller 134 is rotationally driven by the rotation of the transfer belt 133. A (not-illustrated) high voltage circuit (high-voltage power supply) applies a high voltage to the charger roller 134 at predetermined patterns. A discharge roller 138 is configured to transfer the sheet 20 on which an image is recorded to the output tray 140 and is provided downstream of the transfer mechanism 130.

In the image forming apparatus 100 according to the first embodiment, the transfer belt 133 circumferentially travels in a direction indicated by the arrow in FIG. 2 and is positively charged by coming into contact with the charger roller 134 to which the high voltage is applied. In this case, the transfer belt 133 is charged at predetermined charging pitches by allowing the charger roller 134 to switch polarities at predetermined intervals.

Note that when the sheet 20 is fed onto the transfer belt 133 charged with a high voltage, the internal sheet 20 reaches a polarized state. Accordingly, a contact surface between the transfer belt 133 and the sheet 20 electrostatically induces charges having a polarity opposite to the polarity of the charges on the transfer belt 133. The charges induced on the transfer belt 133 and those induced on the sheet 20 are electrostatically attracted to one another, so that the sheet 20 is electrostatically adsorbed onto the transfer belt 133. Accordingly, warping and curves of the sheet 20 are straightened due to strong adsorption of the sheet 20 onto the transfer belt 133 such that a highly flat surface configuration of the sheet 20 may be maintained.

Figure 6:
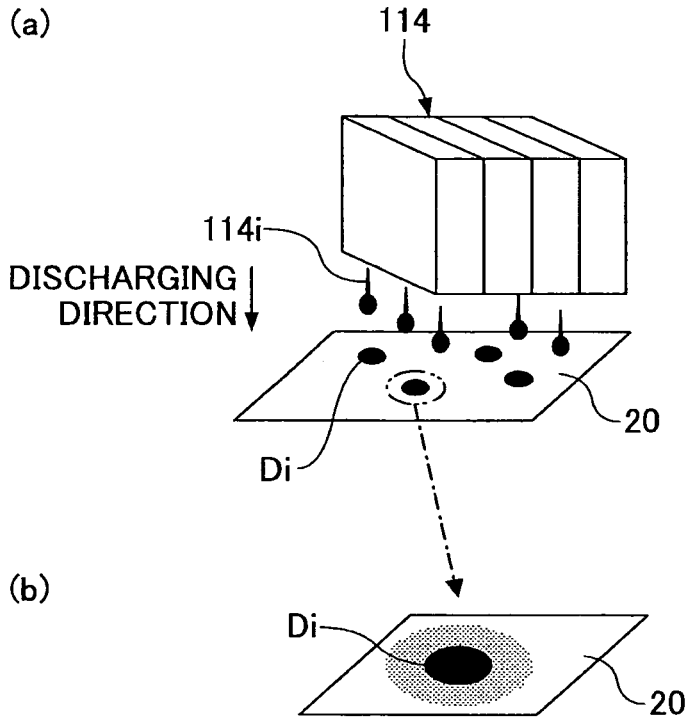
FIG. 6 is a diagram illustrating an example of liquid droplets discharged from the recording head.

The sheet 20 is moved by circumferentially moving the transfer belt 133 and the recording head 114 is driven based on an image signal while the carriage 113 is moved in a single direction or both directions. The recording head 114 is configured to discharge (inject) liquid droplets 114*i* onto the stationary sheet 20 such that the dropped liquid droplets 114*i* each form dots as illustrated in FIG. 6, thereby recording a line of dots. Thereafter, the sheet 20 is transferred by a predetermined amount, and the next line of dots are formed in the same fashion as the above-described fashion sheet 20. FIG. 6 is a diagram illustrating an example of liquid droplets discharged from the recording head.

The recording operation is terminated when a signal indicating that a rear end of the sheet 20 has reached a recording region. Note that in FIG. 6, illustration of (b) is an enlarged portion of a dot Di illustrated in (a).

The sheet 20 on which the image is thus recorded is discharged by the discharge roller 138 onto the output tray 140.

Figure 7:
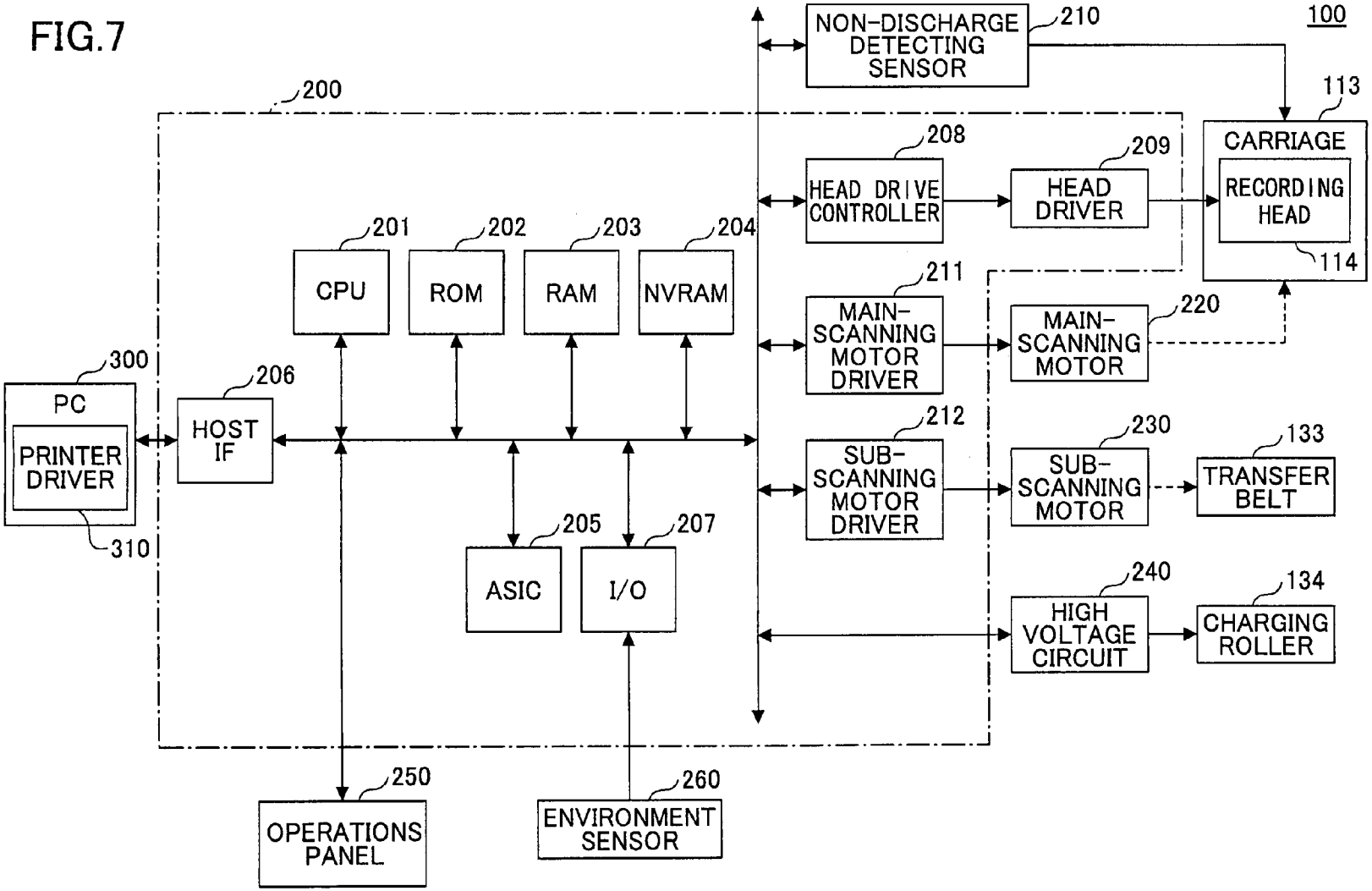
FIG. 7 is a diagram illustrating a functional configuration of the image forming apparatus according to the first embodiment.

Next, a functional configuration of the image forming apparatus 100 according to the first embodiment is described with reference to FIG. 7. FIG. 7 is a diagram illustrating the functional configuration of the image forming apparatus 100 according to the first embodiment.

The image forming apparatus 100 according to the first embodiment includes a controller 200, a non-discharge detecting sensor 210, a main-scanning motor 220, a sub-scanning motor 230, a high voltage circuit 240, an operations panel 250 and an environment sensor 260. The image forming apparatus 100 according to the first embodiment is connected to a personal computer (PC) 300 having a printer driver 310 such that the image forming apparatus 100 form an image based on the image data created by the PC 300.

The controller 200 controls operations of the image forming apparatus 100. The non-discharge detecting sensor 210 detects one or more nozzles having an inferior discharging ability of the recording head 114 provided in the carriage 113. For example, the non-discharge detecting sensor 210 may be configured such that a light-emitting element arranged on one end of the head and a light-receiving element arranged the other end of the head. With this configuration, the nozzles having the inferior discharge ability may be detected based on whether the light-receiving element receives the light emitted by the light-emitting element when ink droplets are discharged from the nozzles.

The main-scanning motor 220 is configured to drive the carriage 113. The sub-scanning motor 230 is configured to drive the transfer belt 133. The high voltage circuit 240 is configured to charge the charger roller 134. The operations panel 250 is utilized for a user to operate the image forming apparatus 100, and the operations panel 250 may include a display function. The environment sensor 260 is configured to detect an ambient temperature and ambient humidity.

The controller 200 provided in the image forming apparatus 100 according to the first embodiment is described below. The controller 200 includes a Central processing unit (CPU) 201, a read only memory (ROM) 202, a random access memory (RAM) 203, a non volatile RAM (NVRAM) 204, an application specific integrated circuit (ASIC) 205, a host interface (host IF) 206, an input-output device (I/O) 207, a head drive controller 208, a head driver 209, a main-scanning motor driver 211 and a sub-scanning motor driver 212.

The CPU 201 is configured to control overall operations of the image forming apparatus 100. The ROM 202 is configured to store programs to be executed by the CPU 201 and other fixed data. The RAM 203 is configured to temporarily store data such as image data. The NVRAM 204 is formed of a non volatile memory capable of holding data while the image forming apparatus 100 is shut down. The ASIC 205 is configured to carry out various signal processing, image processing including rearrangement of image data, and other input and output signal processing for controlling overall operations of the image forming apparatus 100. The host IF 205 serves as an interface to transmit or receive data or signals between the image forming apparatus 100 and the PC 300. The I/O 207 is configured to be supplied with detected signals from the environment sensor 260 or other various sensors (not illustrated).

The head drive controller 208 and the head driver 209 are configured to control the drive of the recording head 114. The main-scanning motor driver 211 is configured to drive the main-scanning motor 220. The sub-scanning motor driver 212 is configured to drive the sub-scanning motor 230.

The host IF 206 of the controller 200 receives via cables or the net printing data including image data acquired from the PC 300 side where the image data are formed by an image reader such as an image scanner or a data processing apparatus, or an imaging device such as a digital camera. Note that the printer driver 310 of the PC 300 generates printing data and supplies the generated printing data to the controller 200.

The CPU 201 retrieves the printing data from a receiver buffer in the host IF 206 to analyze the retrieved printing data, causes the ASIC 205 to carry out a desired process such as rearrangement of data, and transfers the processed data to the head drive controller 208. Note that the conversion of the printing data into bitmap data for outputting image data may be carried out by the printer driver 310 that expands the image data as the bitmap data to transfer the converted bitmap data as described above. However, the conversion may be carried out by storing font data in the ROM 202.

When the head drive controller 208 receives the image data ("dot pattern data") corresponding to one array of the recording head 114, the head drive controller 208 transmits the dot pattern data as serial data to the head driver 209 in synchronization with a clock signal and also transmits a latch signal to the head driver 209 at predetermined timing.

The head drive controller 208 includes a ROM (may be the ROM 202) that stores pattern data of a driving waveform (driving signal), and a driving waveform generator circuit including a waveform generator circuit having a D/A converter configured to D/A convert driving waveform data retrieved from the ROM, and an amplifier.

The head driver 209 selectively supplies a desired driving waveform to an actuator of the recording head 114 based on a signal supplied from the head drive controller 208, thereby controlling the recording head 114.

Figure 8:
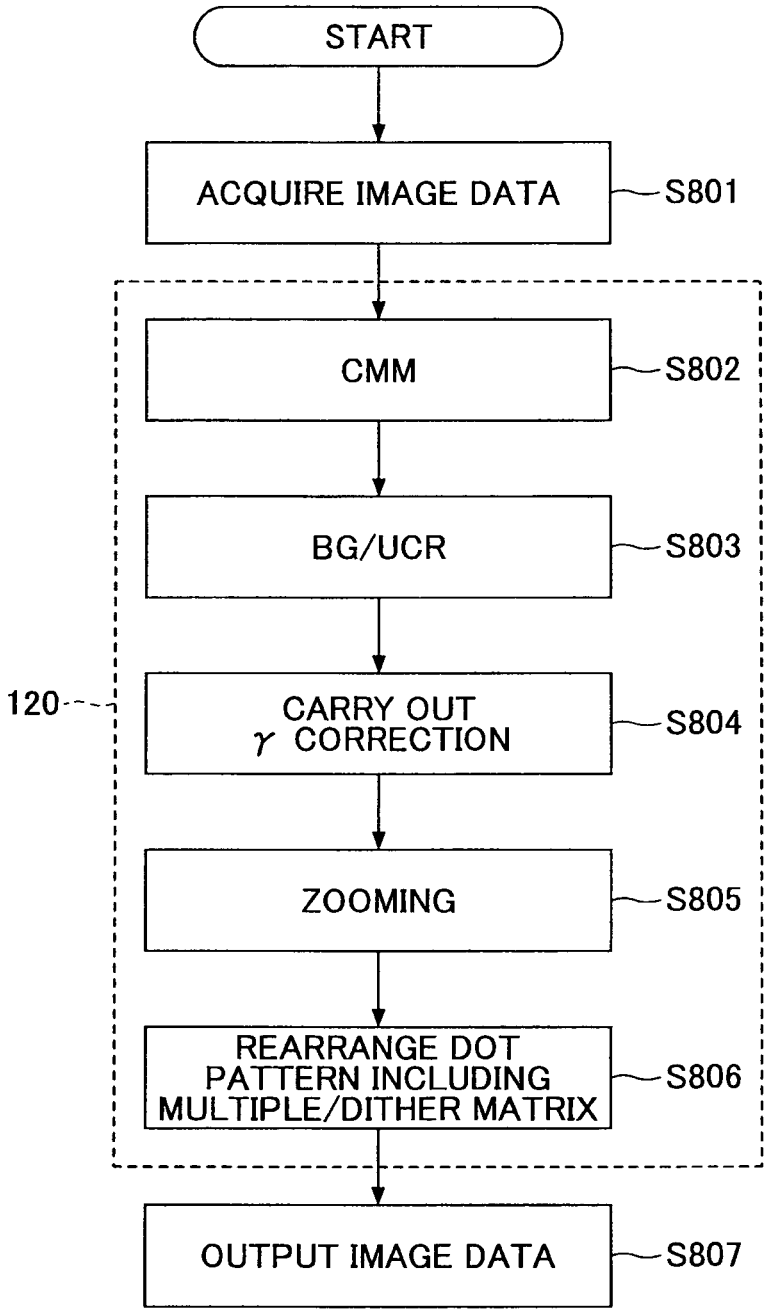
FIG. 8 is a flowchart illustrating processes carried out by a personal computer (PC) connected to the image forming apparatus.

Next, the PC 300 connected to the image forming apparatus 100 according to the first embodiment is described with reference to FIG. 8. FIG. 8 is a flowchart illustrating processes carried out by the PC 300 connected to the image forming apparatus 100.

The PC 300 includes the printer driver 310 to transfer the image data to the image forming apparatus 100. FIG. 8 illustrates the processes carried out by the printer driver 310.

When the printer driver 310 acquires image data from application software or the like (step S801), the printer driver 310 converts a color space of the acquired image data for a monitor display into a color space for the image forming apparatus (i.e., RGB display color space into CMY display color space) (step S802). Subsequently, the printer driver 310 carries out a black generation/under color removal (BG/UCR) conversion on the CMY values of CMY display color space of the image data (step S803).

Subsequently, the printer driver 310 carries out γ correction that is input-output signal correction to reflect properties of the image forming apparatus or preferences of a user (step S804), and carries out an enlarging process based on the resolution of the image forming apparatus 100 (step S805). The printer driver 310 carries out a halftone process including a multiple/dither matrix in which dots (dot pattern) of the image data are rearranged to dots (dot pattern) to be discharged by the image forming apparatus 100 (step S806), and the image data having rearranged dots (dot pattern) are output to the image forming apparatus 100 (step S807).

In the image forming apparatus 100 according to the first embodiment, when an image is formed based on the image data transferred from the printer driver 310, whether there is a defective nozzle incapable of properly discharging liquid droplets is detected among the nozzles of the recording head 114. If a defective nozzle is detected (found), the image forming apparatus 100 corrects the image having a corresponding defective part formed due to the defective nozzle. The image forming apparatus 100 according to the first embodiment includes its own specific features of a correcting method and hence, the features of the correcting method will be described below.

Figure 9:
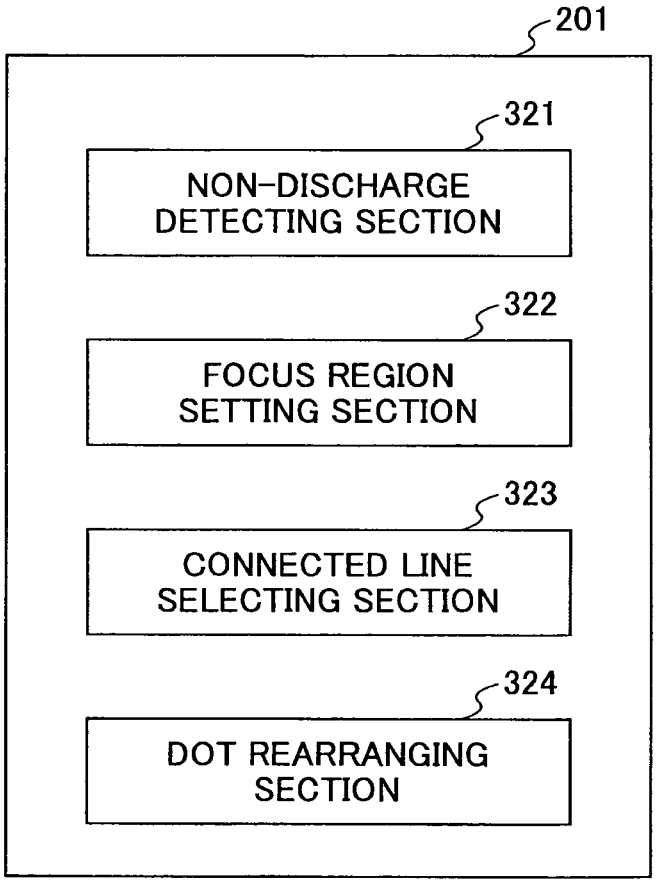
FIG. 9 is a functional block diagram illustrating a central processing unit (CPU) of the image forming apparatus according to the first embodiment.

FIG. 9 is a functional block diagram illustrating the CPU 201 of the image forming apparatus 100 according to the first embodiment. In the image forming apparatus 100 according to the first embodiment, the CPU 201 detects whether there is a defective nozzle incapable of properly discharging liquid droplets based on signals from the non-discharge detecting sensor 210, and corrects, if the defective nozzle is detected, the image.

The CPU 201 includes a non-discharge detecting section 321, a focus region setting section 322, a connecting line selecting section 323 and a dot rearranging section 324.

When the non-discharge detecting section 321 of the CPU 201 detects a defective nozzle incapable of properly discharging liquid droplets (hereinafter simply called "defective nozzle"), the focus region setting section 322 of the CPU 201 sets a predetermined region as a focus region, which includes dots (expected defective dots) to be formed of liquid droplets discharged from the defective nozzle in a central part. The connecting line selecting section 323 selects a line (connected line) formed by connecting the expected defective dots arranged in the focus region, and the dot rearranging section 324 rearranges dots such that a slope of the connected line and a value indicating a tonal size of the dots in the focus region are unchanged. Note that the rearranged dots include the expected defective dots.

The above functional components of the CPU 201 are described in more detail below. The non-discharge detecting section 321 determines whether there is a defect nozzle existing among the nozzles of the recording head 114 based on the signals acquired from the non-discharge detecting sensor 210. When the non-discharge detecting section 321 detects the existence of the defect nozzle, the non-discharge detecting section 321 sets a flag indicating the existence of the nozzle to detect a location of the defective nozzle.

The focus region setting section 322 sets a predetermined region of the image located having the expected defective dot forming position in the central part of the predetermined region as a focus region. In this example, the focus region setting section 322 sets a region of 3*3 dots including the expected defective dot forming position in the central part of the region is as the focus region. Note that the setting range of the focus region may be set in the image forming apparatus 100 in advance, or the setting range of the focus region may be changeable.

When the image is formed based on the image data provided by the PC 300, the connecting line selecting section 323 selects the connected line formed by connecting the gravity centers of the dots arranged in the focus region.

The dot rearranging section 324 rearranges the dots in the focus region based on the slope of the connected line and values indicating the respective sizes of the dots in the focus region. The dot rearranging section 324 rearranges the dots by changing the locations and the sizes of the dots while maintaining the slope of the connected line formed in the focus region acquired when the image is formed based on the image data provided by the PC 300.

More specifically, the dot rearranging section 324 rearranges the dots in the focus region such that the rearranged dots form a connected line having a slope equal to the connected line formed of the dots before rearrangement, and the rearranged dots have a value indicating a total dot size of the dots in the focus region the same as the value indicating the total dot size of the dots before rearrangement. Details of the dot rearranging section 324 are described later.

Figure 10:
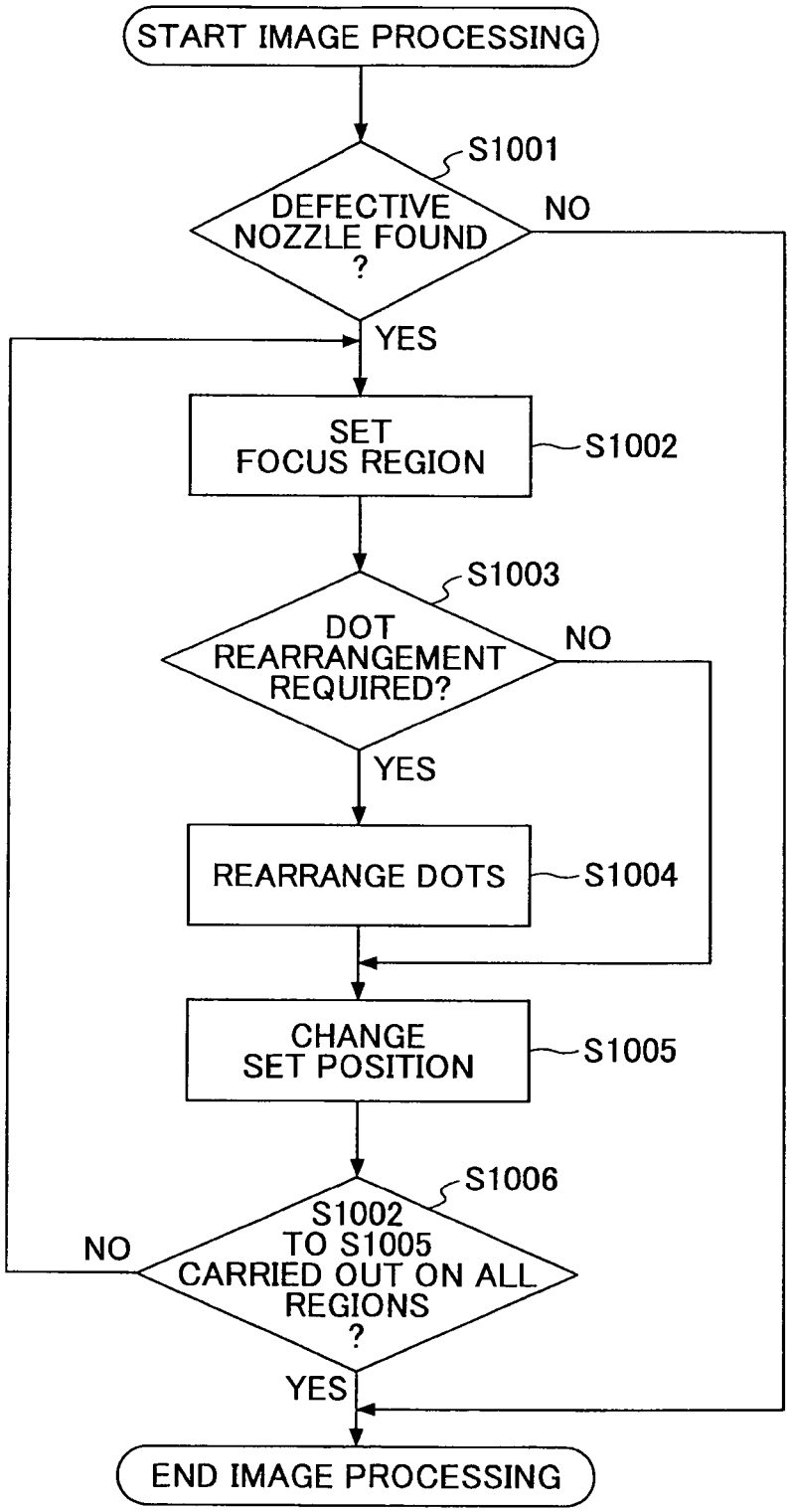
FIG. 10 is a diagram illustrating operations of the image forming apparatus according to the first embodiment.

Next, operation of the image forming apparatus 100 according to the first embodiment is described with reference to FIG. 10. FIG. 10 is a diagram illustrating the operations of the image forming apparatus 100 according to the first embodiment.

When the image forming apparatus 100 according to the first embodiment starts image forming processing, the CPU 201 causes the non-discharge detecting section 321 to detect the defective nozzle (step S1001). Note that the non-discharge detecting section 321 may cause the nozzles to discharge ink droplets before carrying out the image forming process based on the image data to determine whether there is a defect nozzle existing among the nozzles of the recording head 114 based on the result of the discharged droplets of the nozzles.

When the non-discharge detecting section 321 detects the defective nozzle in step S1001, the CPU 1002 causes the focus region setting section 322 to set the focus region (step S1002). When the focus region setting section 322 sets the focus region in step S1002, the CPU 201 determines whether the dots within the focus region require rearrangement (step S1003). For example, the CPU 201 determines that rearrangement is required when the focus region includes an expected defective dot to be formed by a defect nozzle detected in step S1001. The CPU 201 corrects a defect of the image due to the liquid droplet of the defective nozzle by rearranging the dots in the focus region. Further, the CPU 201 determines that the dot rearrangement is not required when the focus region includes no expected defective dot.

When the CPU 201 determines that the dot rearrangement is required in step S1003, the CPU 201 causes the dot rearranging section 324 to rearrange the dots in the focus region (step S1004).

Figure 11A:
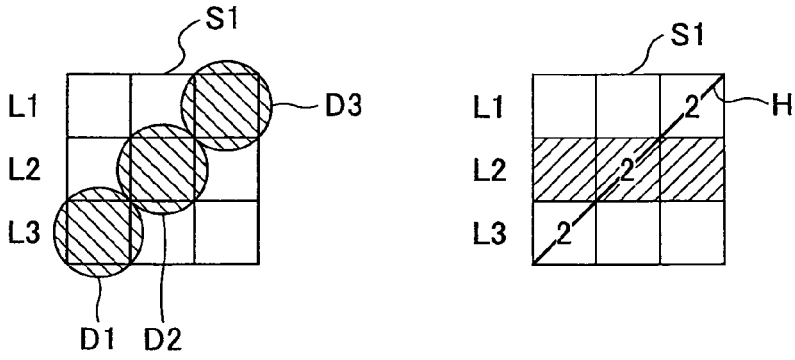
FIGS. 11A to 11D are first diagrams illustrating examples of rearrangement of dots in the image forming apparatus according to the first embodiment.

Below, details of the processes carried out in steps S1002 to S1004 are described with reference to FIGS. 11A and 12C. FIGS. 11A to 11D are diagrams illustrating an example of the dot rearrangement in the image forming apparatus 100 according to the first embodiment, FIGS. 12A to 12C are diagrams illustrating another example of the dot rearrangement in the image forming apparatus 100 according to the first embodiment.

Figure 11B:
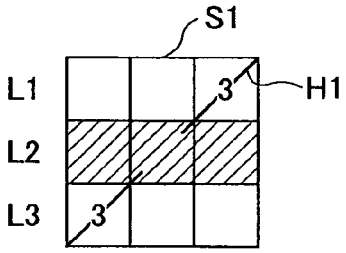
Figure 11C:
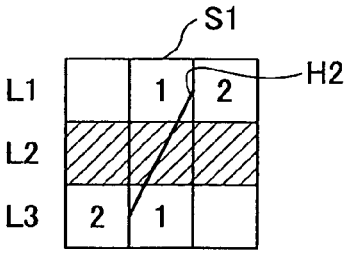
Figure 11D:
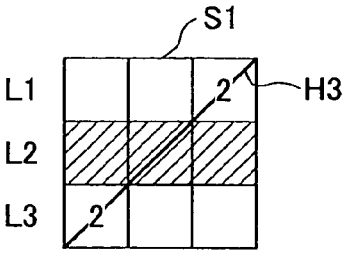
Figure 12A:
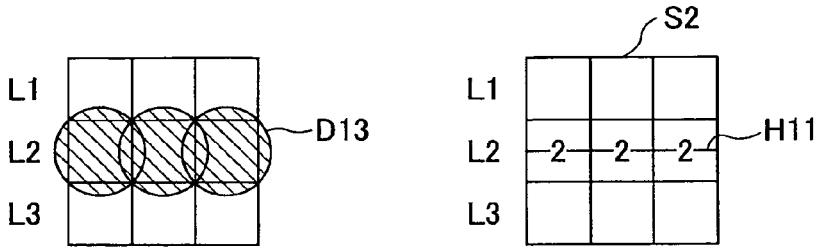
FIGS. 12A to 12C are second diagrams illustrating examples of rearrangement of dots in the image forming apparatus according to the first embodiment.
Figure 12B:
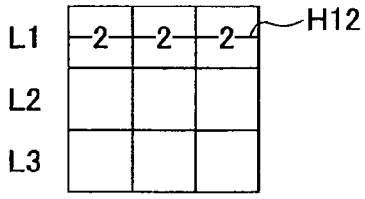
Figure 12C:
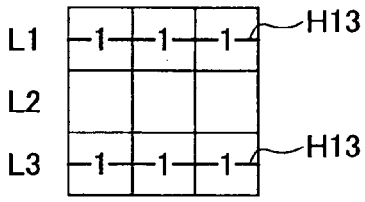

FIGS. 11A to 11D illustrate the example of the dot rearrangement in which the slope of 45 degrees of the connected line is corrected. FIG. 11A illustrates the line formed based on the image data input from the PC 300, FIG. 11B illustrates an example to which the correction according to the first embodiment is applied, and FIGS. 11C and 11D illustrate examples to which the correction according to the first embodiment is not applied.

In FIG. 11A, if there is no defective nozzle existed in the recording head 114, dots D1, D2 and D3 are formed in a region S1. In this case, the connected line H (see diagram on the right hand side of FIG. 11A) is formed by connecting the gravity centers of the dots D1, D2 and D3 in the region S1. The droplet size of the liquid droplets forming dots D1, D2 and D3 may be determined as a medium size represented by the value of 2, and hence the total size of the liquid droplets forming the dots D1, D2 and D3 may be represented by the value of 6.

Note the value indicating the size of the liquid droplet is described below. The image forming apparatus that discharges ink droplets to form an image generally form dots of different sizes by adjusting a size of the ink droplet. The ink droplets may be formed in large, medium and small sizes. For example, the large ink droplet forms a large dot, and the small ink droplet forms a small dot. Within the image forming apparatus 100 according to the first embodiment, dot sizes and numerical values corresponding to the dot sizes are set in advance, and hence the dot sizes are presented by the numerical values corresponding to the dot sizes.

For example, a dot size formed of a small ink droplet is represented by the numerical value of 1, a dot size formed of a medium ink droplet is represented by the numerical value of 2, and a dot size formed of a large ink droplet is represented by the numerical value of 3. In FIG. 11A, the dots D1, D2 and D3 are each formed of a medium sized ink droplet having a numerical value of 2 (see diagram on the right hand side). Note that the amount of ink droplet may also be used as the numerical value representing the dot size.

Next, the correction performed is illustrated with reference to FIGS. 11B to 11D in a case where there is a defective nozzle that forms a dot in a line L2 of the lines L1, L2 and L3 in the region S1. In FIG. 11A, the dot D2 represents an expected defect dot.

FIG. 11B illustrates the region S1 to which the correction is applied by rearrangement of the dots. The dot rearranging section 324 analyses the image data acquired from the PC 300 to detect the locations of the dots in the region S1 before rearranging the dots, and computes the slope of the connected line H. The slope of the connected line H indicates the slope of the line image expressed by the image data in the region S1.

The dot rearranging section 324 rearranges the dots in the region S1 such that the rearranged dots may maintain the slope of the connected line H the same as that of the connected line H before the rearrangement of the dots. Further, the dot rearranging section 324 rearranges the dots in the region S1 such that the rearranged dots may have the total value indicating the total dot size of the region S1 the same as that indicating the total dot size of the region S1 before rearrangement.

If the nozzle that forms the line L2 is defective one, the focus region is set based on the expected defect dot to be formed by the defect nozzle locating the center of the focus region. In the first embodiment, the focus region is formed of 3*3 dots and the region S1 corresponds to the focus region. When the focus region is set, the dot rearranging section 324 selects the connected line H formed by connecting the gravity centers of the dots D1, D2 and D3 in the region S1 and changes the sizes of the dots D1 and D3 while maintaining the slope of the connected line H. In this case, the dot rearranging section 324 changes the sizes of the dots D1 and D3 while maintaining the total value (representing total dot size) of the value indicating the dot size of the dot D1 and the value indicating the dot size of the dot D2 the same as the total value of the total dot size of the image formed based on the image data acquired from the PC 300.

In FIG. 11B, if the dot sizes of the dots D1 and D3 are each 3, the tonal value indicating the total dot size of the region S1 is 6, which indicates the same value as the total value of the region S1 before rearrangement of the dots. Further, the connected line H1 connecting the gravity centers of the dots D1 and D3 has the same slope as that of the connected line H. The image having the defective dot formed by the defective nozzle may be corrected in this fashion without changing the thickness of the line and without disconnecting the line.

In the example of FIG. 11C, although the image is corrected by increasing the number of dots in the lines L1 and L3, the slope angle of the connected line H2 may not be the same as that of the connected line H1. Thus, the line image may be deformed.

In the example of FIG. 11D, although the connected line H2 has the slope angle the same as that of the connected line H, the total value indicating the total dot size of the region S1 is 4, which is not the same as the total value obtained in the image of FIG. 11A. In this case, since the amount of ink attached is small, the line image may be thin and broken.

FIGS. 12A to 12C illustrate an example of the dot rearrangement in which the slope of 0 degrees of the connected line H11 is corrected. FIG. 12A illustrates the line formed based on the image data input from the PC 300. FIG. 12B illustrates an example to which the correction according to the first embodiment is applied. FIG. 12C illustrates an example to which the correction according to the first embodiment is not applied.

In the example of FIG. 12B, the connected line H12 has the slope angle the same as that of the connected line H11 of FIG. 12A, and the total value indicating the total dot size of the region S1 is also the same as the total value indicating the total dot size of the region S1 of FIG. 12A. In FIG. 12B, the image having a defect due to the defective nozzle is corrected such that the corrected image includes the line that is shifted up to the next level without changing the thickness of the line and without disconnecting the line.

In the example of FIG. 12C, since dots are disposed in lines L1 and L3, two connected lines H13 are formed, which do not match the connected line H11 of FIG. 12A. Thus, since the example of FIG. 12C includes two lines, it may not be corrected without changing the shape of the line.

Figure 13A:
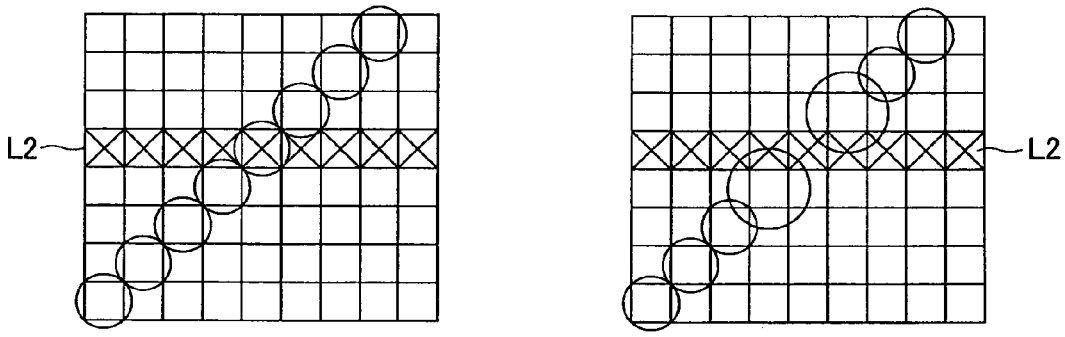
FIGS. 13A and 13B are diagrams illustrating examples of rearranged dots in the image forming apparatus according to the first embodiment.
Figure 13B:
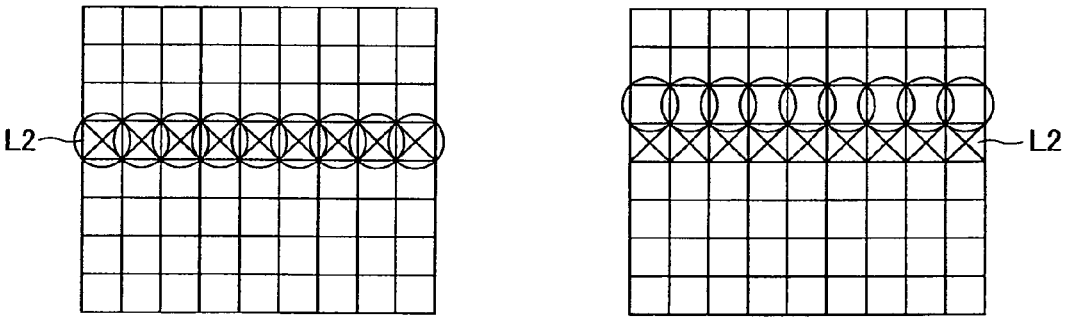

FIGS. 13A and 13B are diagrams illustrating examples of rearranged dots according to the first embodiment. FIG. 13A illustrates a case where the correction illustrated in FIG. 11B is applied to the image having the defect, and FIG. 13B illustrates a case where the correction illustrated in FIG. 12B is applied to the image having the defect.

Figure 14:
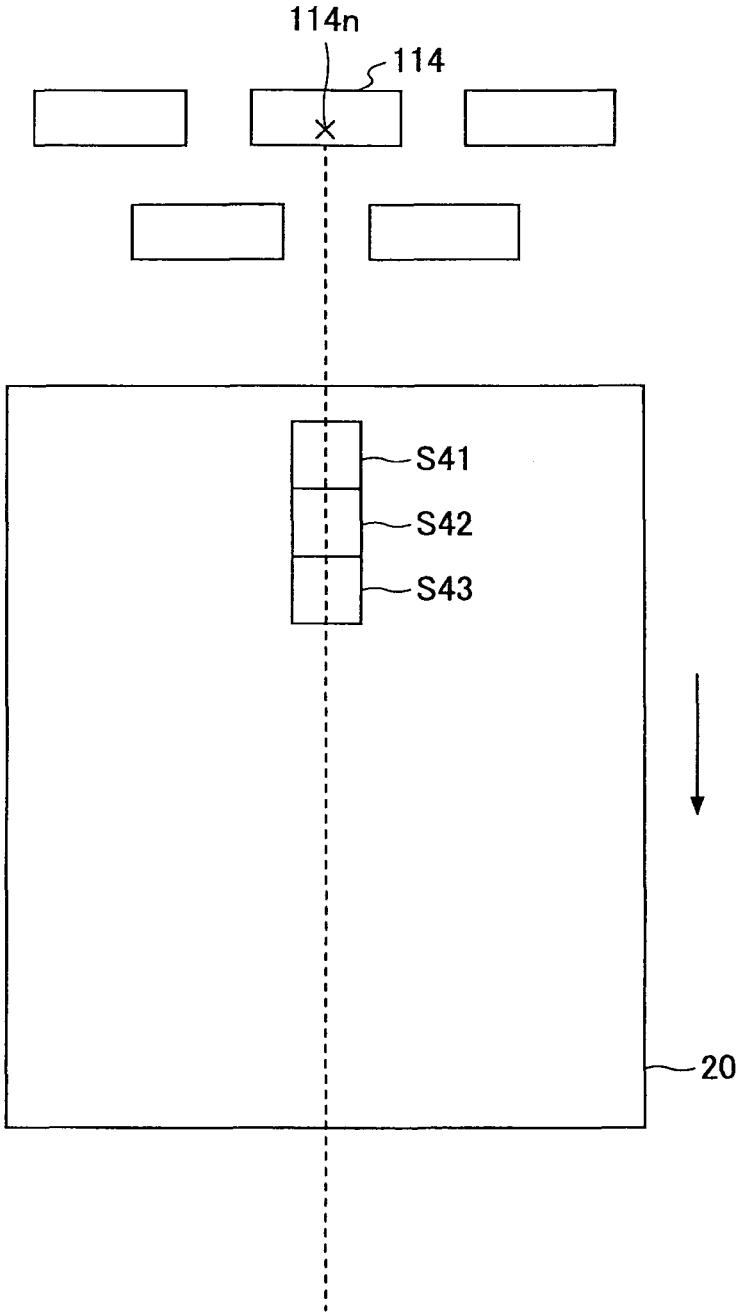
FIG. 14 is a diagram illustrating an example in which the set position of the focus region is changed.

Subsequently, the CPU 201 changes the set position of the focus region of the image (step S1005). Below, the change of the set position of the focus region is described with reference to FIG. 14. FIG. 14 is a diagram illustrating an example in which the set position of the focus region is changed.

For example, if the nozzle pore 114*n* of the recording head 114 is a defective nozzle and the sheet 20 is transferred in a direction indicated by an arrow in FIG. 14 and an image is formed on the transferred sheet 20, the dot (i.e., expected defective dot) formed by defective nozzle 114*n* results in a defective dot. The focus region setting section 322 sets a focus region by following a line L4 (not illustrated) including the defective dot (expected defective dot).

The image forming apparatus 100 according to the first embodiment sets a region S41 having the line L4 locating in the center of the region S41 as the focus region and carries out processes of steps S1103 to S1005. Next, the image forming apparatus 100 carries out similar processes by setting a region S42 adjacent to the region S41 having the line L4 locating in the center of the region S42 as the focus region. Similar processes are carried out on a region S43.

The CPU 201 checks whether processes of steps S1002 to S1005 are carried out on all the regions including the expected defective dots (step S1006). In the example of FIG. 14, the CPU 201 checks whether the processes of steps S1002 to S1005 are carried out on the regions including a start point to an end point of the line L4.

In step S1006, if the processes of steps S1002 to S1005 are carried out on all the regions, the image processing is terminated. If, on the other hand, the processes of steps S1002 to S1005 are yet to be carried out on all the regions, the processes subsequent to the step S1002 are repeatedly carried out.

In the image forming apparatus 100 according to the first embodiment, a dot pattern formed of the dots of the image data supplied from the PC 300 is rearranged in this fashion. Thus, the image forming apparatus 100 may form an image based on the dot pattern obtained after the rearrangement of the dots, which may reduce the defect or streaks of the image formed due to the defective nozzle.

According to the image forming apparatus 100 according to the first embodiment, the streaks obtained due to the defective nozzle may be reduced without deforming the shape of the line image by correcting the image having the defect obtained due to the defective nozzle.

Second Embodiment

Next, an image forming apparatus 100 according to a second embodiment is described with reference to the accompanying drawings. The image forming apparatus 100 according to the second embodiment differs from the image forming apparatus according to the first embodiment in that the location of the defective nozzle and a rearranged pattern (obtained after the rearrangement of the dot pattern) corresponding to the dot pattern of the image data are stored in advance in a storage device. Accordingly, in the second embodiment, the difference between the first and second embodiments is described, and functional components of the second embodiment similar to those of the first embodiment are provided with the same reference numerals and are not described again.

Figure 15:
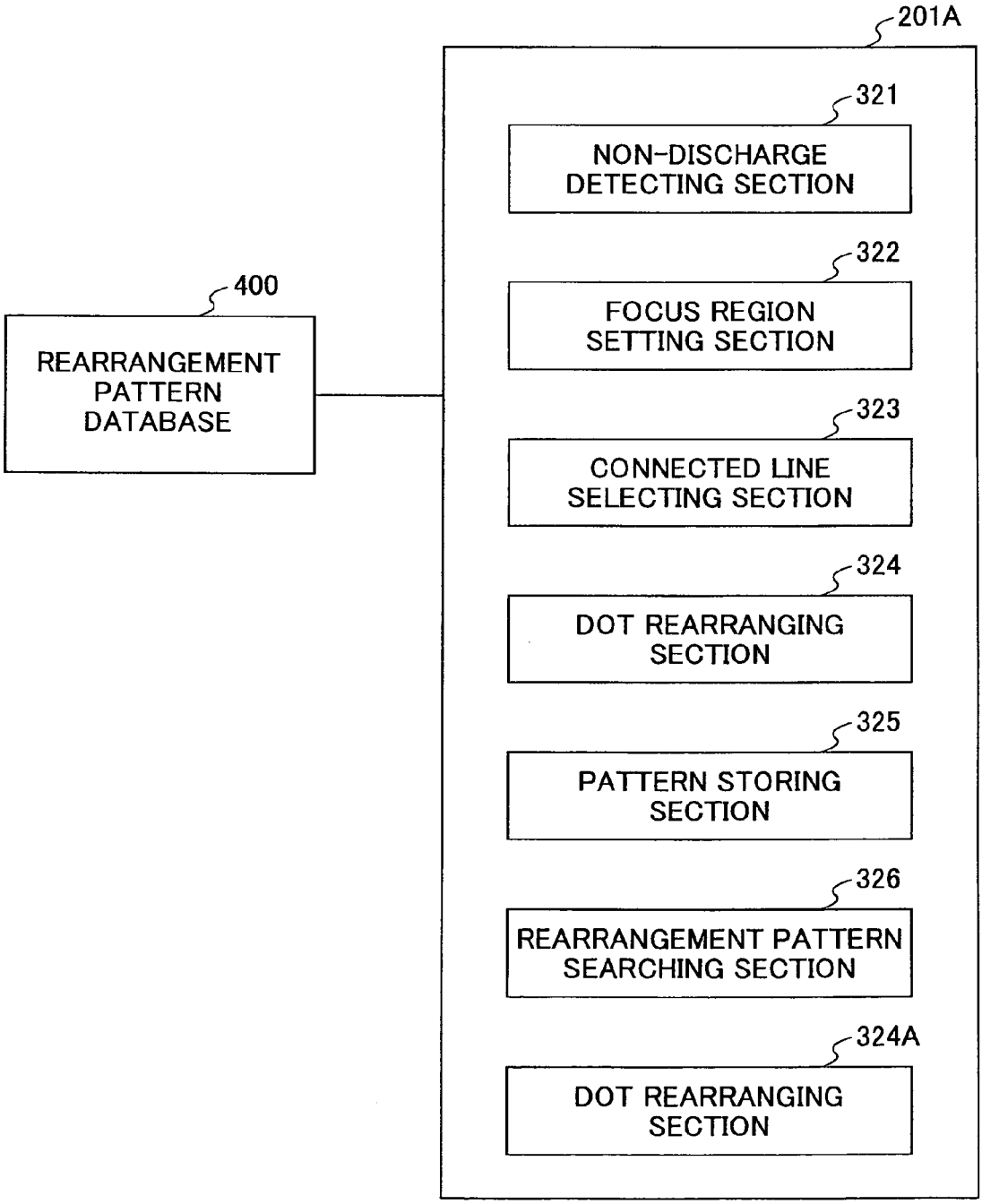
FIG. 15 is a functional block diagram illustrating a central processing unit (CPU) of an image forming apparatus according to a second embodiment.

FIG. 15 is a functional block diagram illustrating a CPU 201A of the image forming apparatus 100 according to the second embodiment. The CPU 201A of the second embodiment further includes a rearranging section 324A, a pattern storage section 325, and a rearranged pattern searching section 326 in addition to the functional components of the CPU 201 of the first embodiment. The CPU 201A of the second embodiment is connected to the storage device storing a rearranged pattern database 400. The CPU 204A rearranges the dots forming a dot pattern based on a rearranged pattern corresponding to the dot pattern stored in the rearranged pattern database 400.

The rearranged pattern database 400 utilized in the image forming apparatus 100 according to the second embodiment is described below. In the image forming apparatus 100 according to the second embodiment, the rearranged pattern database 400 may be stored in the storage device such as a ROM 202 or an NVRAM 204 contained in a controller 200. The rearranged pattern database 400 stores an expected defective dot forming position in the focus region, a dot pattern of the dots before rearrangement in the focus region and a rearranged dot pattern of the dots after rearrangement in the focus region in association with one another. The dot pattern of the dots before rearrangement in the focus region indicates a dot pattern expressed by the image data supplied from the PC 300.

Specifically, the rearranged pattern database 400, for example, stores the line L2 including the expected defective dot in the focus region S1 illustrated in FIG. 11A in association with the dot pattern expressed by the image data supplied from the PC 300 and the dot pattern after the correction is applied illustrated in FIG. 11B. The rearranged pattern database 400 further stores the line L2 including the expected defective dot in the focus region S2 illustrated in FIG. 12A in association with the dot pattern expressed by the image data supplied from the PC 300 and the dot pattern after the correction is applied illustrated in FIG. 12B.

Figure 16A:
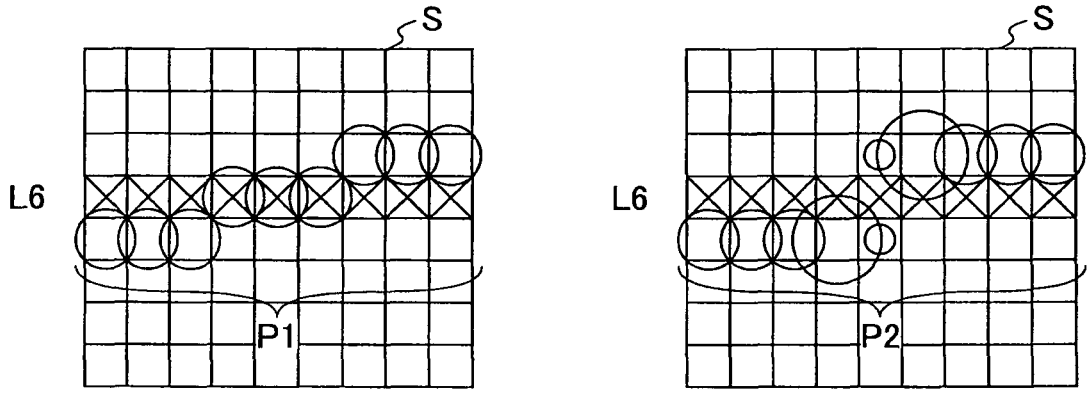
FIGS. 16A and 16B are first diagrams illustrating examples of rearranged dot patterns stored in a rearranged pattern database.
Figure 16B:
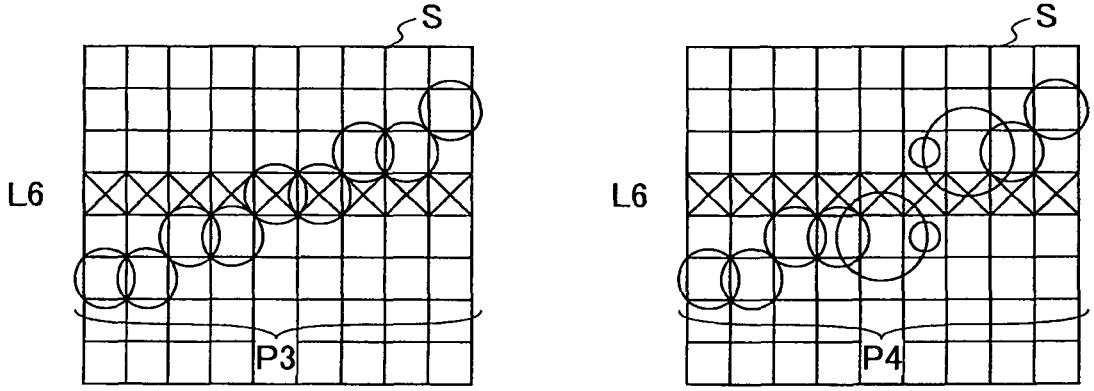

The rearranged pattern database 400 further stores various dot patterns in addition to the above-described patterns. Examples of the dot patterns stored in the rearranged pattern database 400 are further described with reference to FIGS. 16A to 17C. FIGS. 16A and 16B are diagrams illustrating first examples of the dot patterns stored in the rearranged pattern database 400, and FIGS. 17A to 17C diagrams illustrating second examples of the dot patterns stored in the rearranged pattern database 400. Note that the rearranged patterns after the correction is applied illustrated in FIGS. 16A to 17C may preferably the patterns generated by carrying out the correcting process described in the first embodiment.

Note that in FIGS. 16A and 16B, and FIGS. 17A to 17C, the focus region S is formed of 8*9 dots. In FIG. 16A, the expected defective dot forming position corresponds to a line L6 forming position in the focus region S. The dot pattern before the application of correction (before rearrangement of the dot pattern) is a pattern P1 and the dot pattern after the application of the correction (after rearrangement of the dot pattern) is a pattern P2 as illustrated in FIG. 16A. In the rearranged pattern database 400, the above three pieces of information (i.e., position of expected defective dot, dot pattern before correction, and rearranged dot pattern after correction) are associated. In FIG. 16B, the defective nozzle locating position in the focus region S corresponds to the line L6 forming position in the focus region S. Further, the dot pattern before the application of the correction is a pattern P3 and the dot pattern after the application of the correction is a pattern P4.

Figure 17A:
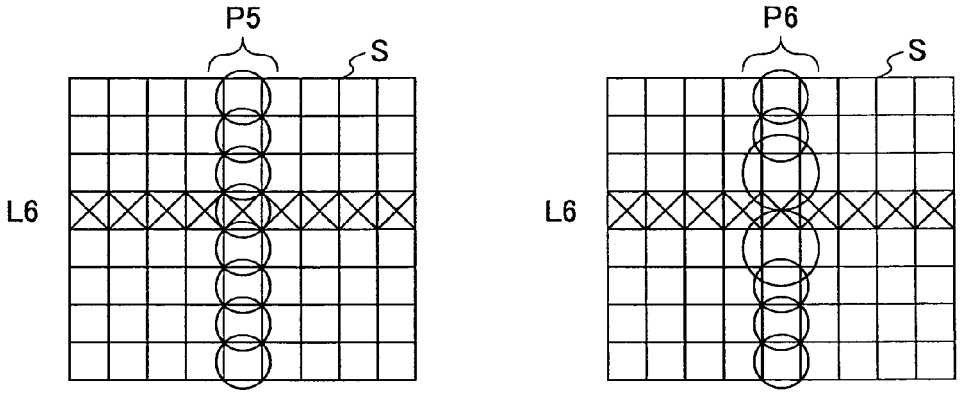
FIGS. 17A to 17C are second diagrams illustrating examples of rearranged dot patterns stored in the rearranged pattern database.
Figure 17B:
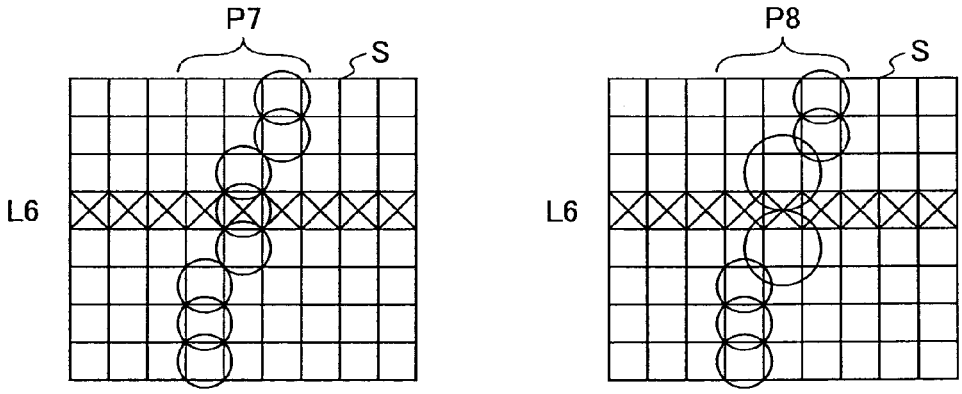
Figure 17C:
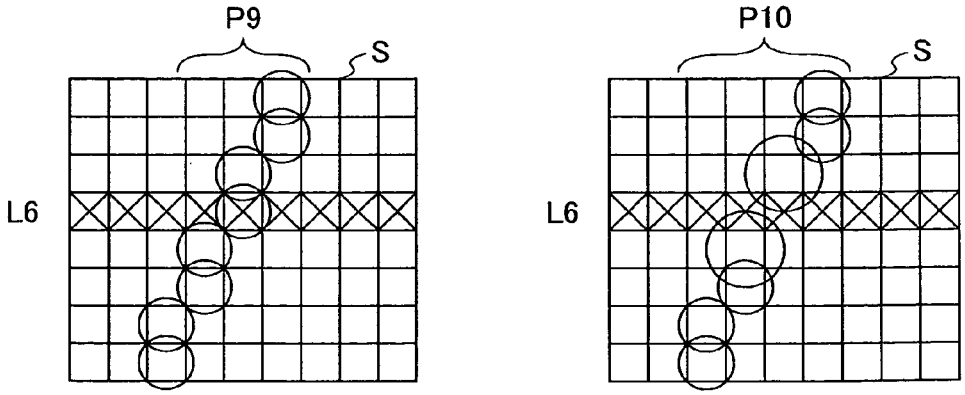

In FIG. 17A, the position at which the expected defective dot to be formed corresponds to the position at which the line L6 is formed in the focus region S. The dot pattern before the application of correction is a pattern P5 and the dot pattern after the application of the correction is a pattern P6. In FIG. 17B, the expected defective dot forming position corresponds to the Line 6 forming position in the focus region S. The dot pattern before the application of correction is a pattern P7 and the dot pattern after the application of the correction is a pattern P8. In FIG. 17C, the expected defective dot forming position corresponds to the Line 6 forming position in the focus region S. The dot pattern before the application of correction is a pattern P9 and the dot pattern after the application of the correction is a pattern P10.

Referring back to FIG. 15, the pattern storage section 325 stores a rearranged dot pattern rearranged by the dot rearranging section 324, a dot pattern before the rearrangement based on the image data supplied from the PC 300, and a position of the defective nozzle in the focus region in the rearranged pattern database 400 by mutually associating these three pieces of information.

The rearranged pattern searching section 326 searches for the rearranged dot pattern in the rearranged pattern database 400. The rearranged pattern searching section 326 searches for the expected defective dot forming position and the dot pattern before rearrangement in the focus region based on the image data supplied from the PC 300 in the rearranged pattern database 400 and selects the rearranged dot pattern associated with the expected defective dot forming position in the focus region and the dot pattern before rearrangement in the focus region.

The rearranged pattern searching section 324 rearranges the dot pattern based on the image data supplied from the PC 300 in the rearranged dot pattern selected from the rearranged pattern database 400.

Figure 18:
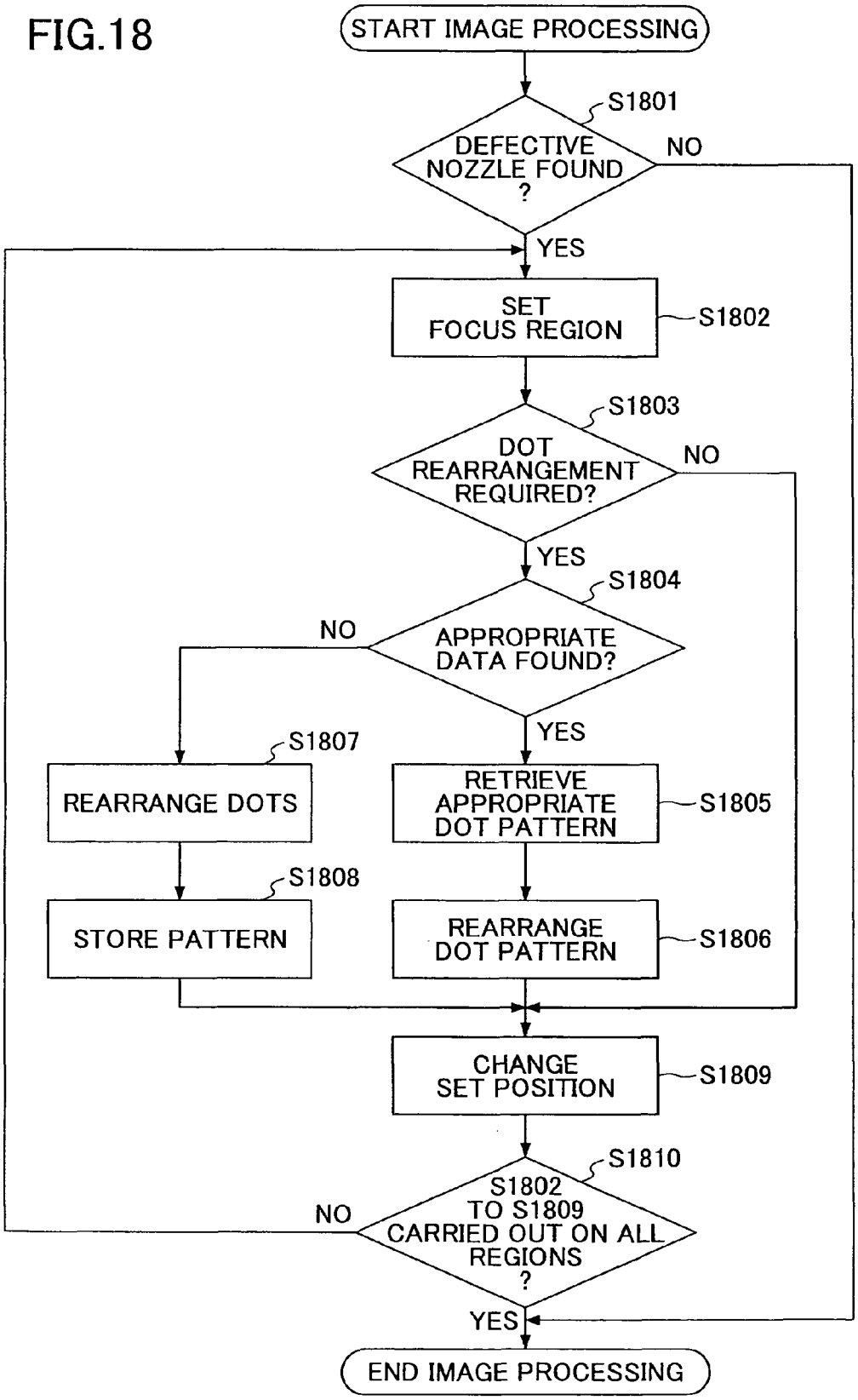
FIG. 18 is a diagram illustrating operations of the image forming apparatus according to the second embodiment.

FIG. 18 is a diagram illustrating operations of the image forming apparatus 100 according to the second embodiment. Note that processes in steps 1801 through S1803 in FIG. 18 are similar to those in steps S1001 through S1003 in FIG. 10, and the corresponding descriptions of the processes in FIG. 18 are thus omitted.

When the CPU 201A determines that the dot rearrangement is required in step S1803, the CPU 201A causes the rearranged pattern searching section 326 to search for the expected defective dot forming position in the rearranged pattern database 400 (step S1804). The rearranged pattern searching section 326 acquires the expected defective dot forming position searched for in step S1801. The rearranged pattern searching section 326 also acquires the image data in the focus region set in step S1802 and the dot pattern expressed by the image data in the focus region. The rearranged pattern searching section 326 searches the rearranged pattern database 400 by the acquired expected defective dot forming position and the dot pattern expressed by the image data as search keys.

Further, in step S1804, if the rearranged pattern searching section 326 has found data corresponding to the search keys in the rearranged pattern database 400, the rearranged pattern searching section 326 retrieves the dot pattern corresponding to the search keys as the rearranged dot pattern from the rearranged pattern database 400 (step S1805). The CPU 201A causes a dot rearranging section 324A to rearrange the dot pattern (i.e., rearrange dots) based on the retrieved rearranged dot pattern and proceeds with a process in step S1809 (step S1806).

Further, in step S1804, if the rearranged pattern searching section 324 has not found data corresponding to the search keys in the rearranged pattern database 400, the dot rearranging section 324 rearranges the dot pattern (dots) based on the connected line connecting the gravity centers of the dots in the focus region selected by the connecting line selecting section 323 (step S1807). The process in step S1807 is similar to the process in steps S1004 in FIG. 10.

When the dots are rearranged in the above-described fashion, the CPU 201A causes the pattern storage section 325 to store the rearranged dot pattern, the defective nozzle position, and the dot pattern before the rearrangement expressed by the image data by associating these pieces of information with one another in the rearranged pattern database 400 (step S1808). Since the rearranged dot pattern is stored in the rearranged pattern database 400 in the above-described manner, the process in step S1807 may be omitted under a certain condition. For example, when there is an image having an expected defective dot where the defective nozzle position and the dot pattern expressed by the image data are the same as those stored in the rearranged pattern database 400, the image may be simply corrected by retrieving the rearranged pattern from the rearranged pattern database 400 without carrying out the process in step S1807.

Note that the processes in steps S1809 and S1810 in FIG. 18 are similar to those insteps S1005 and S1006 in FIG. 10, and the corresponding descriptions of the processes in FIG. 18 are thus omitted.

As described above, since the image forming apparatus 100 according to the second embodiment includes the database storing the rearranged dot pattern in advance, a load imposed upon the correcting process carried out while forming image may be reduced. Note that the second embodiment has described that the rearranged pattern database 400 is stored in the storage device provided in the image forming apparatus 100; however, the rearranged pattern database 400 may not be limited to being stored in the storage device provided in the image forming apparatus 100. The rearranged pattern database 400 may be stored in a storage or memory in the PC 300 side. In this case, after executing the processes in steps S1801 to S1803, the CPU 201A requests the PC 300 side to search for the dot pattern and then receives the found dot pattern from the PC 300 side. Further, the PC 300 side may also carry out the rearrangement of the dot pattern based on the searched result. In this case, the rearranged dot pattern is transmitted to the image forming apparatus 100.

Moreover, in the image forming apparatus according to the second embodiment, if the data corresponding to the search keys are found in the rearranged pattern database 400, the rearranged dot pattern is generated. However, if the data corresponding to the search keys are not found in the rearranged pattern database 400, the correcting process may be terminated.

According to the above-described embodiments, erroneous streaks or stripes formed due to the defective nozzle may be reduced without deforming the line shape of the line image.

Embodiments of the present invention have been described heretofore for the purpose of illustration. The present invention is not limited to these embodiments, but various variations and modifications may be made without departing from the scope of the present invention. The present invention should not be interpreted as being limited to an embodiments that are described in the specification and illustrated in the drawings.

The present application is based on Japanese Priority Application No. 2010-206606 filed on Sep. 15, 2010, with the Japanese Patent Office, the entire contents of which are hereby incorporated by reference.

What is claimed is:

1. An image forming apparatus including a recording head having nozzles discharging ink droplets to form dots on a recording medium based on image data supplied thereto, the image forming apparatus comprising:

a detector configured to detect a defective one of the nozzles, the defective nozzle discharging a defective ink droplet forming an expected defective dot;

a focus region setting unit configured to set a focus region including a position of the expected defective dot to be formed of the defective ink droplet discharged by the detective nozzle; and a rearranging unit configured to rearrange, when the defective nozzle is detected by the detector, the dots in the focus region based on a slope of a line image expressed by the supplied image data in the focus region and values indicating respective sizes of the dots in the focus region.

2. The image forming apparatus as claimed in claim 1, further comprising:

a connected line selecting unit configured to select a connected line formed by connecting respective gravity centers of the dots forming the line image expressed by the supplied image data in the focus region, wherein the rearranging unit rearranges the dots in the focus region such that the rearranged dots form a connected line having a slope the same as the slope of the line image expressed by the supplied image data in the focus region and the rearranged dots have a value indicating a tonal size thereof the same as a value indicating a tonal size of the dots forming the line image expressed by the supplied image data in the focus region.

3. The image forming apparatus as claimed in claim 1, wherein the values indicating the respective sizes of the dots in the focus region are predetermined in association with respective sizes of the ink droplets forming the dots.

4. The image forming apparatus as claimed in claim 3, wherein the values indicating the respective sizes of the dots in the focus region represent respective amounts of the ink droplets forming the dots discharged from the nozzles.

5. The image forming apparatus as claimed in claim 1, wherein the focus region setting unit sets a predetermined region including the expected defective dot locating in a center thereof as the focus region.

6. The image forming apparatus as claimed in claim 1, further comprising a pattern storage unit configured to store the position of the expected defective dot to be formed by the detective nozzle in association with a dot pattern formed of the dots forming the line image expressed by the supplied image data and a rearranged dot pattern of the rearranged dots.

7. The image forming apparatus as claimed in claim 6, further comprising:

a pattern searching unit configured to search, when the defective nozzle is detected by the detector, the pattern storage unit by the position of the expected defective dot in the focus region and the dot the pattern formed of the dots forming the line image expressed by the supplied image data as search keys, wherein when a rearranged dot pattern corresponding to the search keys is found by the pattern searching unit, the rearranging unit retrieves the rearranged dot pattern corresponding to the search keys from the pattern storage unit and rearranges the dot pattern formed of the dots forming the line image expressed by the supplied image data based on the rearranged dot pattern retrieved from the pattern storage unit.

8. A method for forming an image implemented by an image forming apparatus including a recording head having nozzles discharging ink droplets to form dots on a recording medium based on image data supplied thereto, the method comprising:

detecting a defective one of the nozzles, the defective nozzle discharging a defective ink droplet forming an expected defective dot;

setting a focus region including a position of the expected defective dot to be formed of the defective ink droplet discharged by the detective nozzle; and rearranging, when the defective nozzle is detected, the dots in the focus region based on a slope of a line image expressed by the supplied image data in the focus region and values indicating respective sizes of the dots in the focus region.

9. A non-transitory computer-readable medium storing an image forming program for forming an image implemented by an image forming apparatus including a recording head having nozzles discharging ink droplets to form dots on a recording medium based on image data supplied thereto, which, when processed by a processor, causes the image forming apparatus to execute a process, the process comprising:

detecting a defective one of the nozzles, the defective nozzle discharging a defective ink droplet forming an expected defective dot;

setting a focus region including a position of the expected defective dot to be formed of the defective ink droplet discharged by the detective nozzle; and rearranging, when the defective nozzle is detected, the dots in the focus region based on a slope of a line image expressed by the supplied image data in the focus region and values indicating respective sizes of the dots in the focus region.

* * * * *